US011033917B2

(12) United States Patent
Johnson

(10) Patent No.: US 11,033,917 B2
(45) Date of Patent: Jun. 15, 2021

(54) POWDER SIEVING CAPSULE

(71) Applicant: The Government of the United States of America, as represented by the Secretary of the Navy, Arlington, VA (US)

(72) Inventor: Scooter Johnson, Hyattsville, MD (US)

(73) Assignee: The Government of the United States of America, as represented by the Secretary of the Navy, Washington, DC (US)

( * ) Notice: Subject to any disclaimer, the term of this patent is extended or adjusted under 35 U.S.C. 154(b) by 30 days.

(21) Appl. No.: 16/220,233

(22) Filed: Dec. 14, 2018

(65) Prior Publication Data

US 2019/0184415 A1 Jun. 20, 2019

Related U.S. Application Data

(60) Provisional application No. 62/599,055, filed on Dec. 15, 2017.

(51) Int. Cl.
*B05B 7/24* (2006.01)
*B05D 1/12* (2006.01)

(52) U.S. Cl.
CPC . *B05B 7/24* (2013.01); *B05D 1/12* (2013.01)

(58) Field of Classification Search
None
See application file for complete search history.

(56) References Cited

U.S. PATENT DOCUMENTS

| | | | | |
|---|---|---|---|---|
| 6,871,647 | B2 * | 3/2005 | Allan | A61M 15/0045 128/203.15 |
| 7,134,618 | B2 | 11/2006 | Harutyunyan et al. | |
| 7,993,701 | B2 | 8/2011 | Akedo et al. | |
| 2009/0142619 | A1 | 6/2009 | Miyoshi | |
| 2010/0139655 | A1 * | 6/2010 | Genosar | A61M 15/001 128/203.15 |
| 2013/0032145 | A1 * | 2/2013 | Adler | A61M 15/0008 128/203.15 |

OTHER PUBLICATIONS

Johnson et al., "Formation of Thick Film Dense Yttrium Iron Garnet Films Using Aerosol Deposition" J. Vis. Exp. 99, e52843 (2015).
Akedo et al., "Room Temperature Impact Consolidation ([RTIC]) of Fine Ceramic Powder by Aerosol Depostion Method and Applications to Microdevices" J. Therm. Spray Techn. 17, 181 (2008).

* cited by examiner

*Primary Examiner* — Alexander M Weddle
(74) *Attorney, Agent, or Firm* — US Naval Research Laboratory; Joseph T. Grunkemeyer

(57) ABSTRACT

Disclosed is a closable container of a mesh material having openings. When the container is closed, the openings are the only gaps in the container. The openings are no more than 150 microns in diameter.

8 Claims, 8 Drawing Sheets

POWDER SIEVING CAPSULE

This application claims the benefit of U.S. Provisional Application No. 62/599,055, filed on Dec. 15, 2017. The provisional application and all other publications and patent documents referred to throughout this nonprovisional application are incorporated herein by reference.

TECHNICAL FIELD

The present disclosure is generally related to aerosol deposition.

DESCRIPTION OF RELATED ART

In an aerosol deposition process, a dry powder comprised of, for example, 0.1 to 5 micron diameter particles are loaded into an aerosol chamber. The aerosol chamber is mechanically shaken or vibrated to agitate the powder. During the agitation, a carrier gas is fed into the aerosol chamber to further agitate the powder and to entrain the powder into the gas to produce a dry aerosol. The aerosol flows from the aerosol chamber into the deposition chamber via an outlet whereby it attains a large kinetic energy due to the pressure difference. This high-energy particle stream is directed toward a substrate for coating the powder onto the substrate. Upon impact, the particles fracture, deform, and bond forming a dense film.

The particle size plays an important role in whether the particles will hit the substrate and how much energy the impacting particles will have. If the particles are too large, the substrate will be eroded. If the particles are too small, they will be carried away by the gas or bounce off the substrate. Furthermore, the particles must be adequately de-agglomerated before impact with the substrate. This is typically done within the gas jet during transport to the substrate, however if the agglomerate size is too large the particles may not be sufficiently de-agglomerated. This results in non-uniform film coverage and/or undensified regions in the film due to excessive powder impinging over a finite area. To ensure the particles are de-agglomerated before impact careful selection of the starting agglomerate size must be considered.

The powder that is loaded into the aerosol chamber suffers from agglomeration due to van der Waals and/or magnetic interactions between particles. This results in agglomerates that may be up to about 0.5 mm in diameter. Furthermore, the agitation process causes the powder to pack and clump together making separation of the agglomerates for entrainment into the aerosol difficult. The effect of using agglomerates that are too large means that the agglomerate is either too massive to be suspended in the aerosol thereby making the material unusable or if it does reach the outlet the deposition chamber the agglomerate may not break apart into its constituent particles thereby impacting the substrate as an agglomerate. This causes uncompacted regions in the film resulting in poor film quality. The effect of powder packing in the aerosol chamber is that the powder dispersion into the aerosol occurs in an uncontrolled and non-uniform manner. This causes the aerosol jet to become more or less dense with material based on the packing state of the powder. This results in non-uniform film coverage and/or undensified regions in the film due to excessive powder impinging over a finite area.

BRIEF SUMMARY

Disclosed herein is an apparatus comprising a closable container comprising a mesh material having openings.

When the container is closed, the openings are the only gaps in the container. The openings are no more than 150 microns in diameter.

BRIEF DESCRIPTION OF THE DRAWINGS

A more complete appreciation will be readily obtained by reference to the following Description of the Example Embodiments and the accompanying drawings.

DETAILED DESCRIPTION OF EXAMPLE EMBODIMENTS

In the following description, for purposes of explanation and not limitation, specific details are set forth in order to provide a thorough understanding of the present disclosure. However, it will be apparent to one skilled in the art that the present subject matter may be practiced in other embodiments that depart from these specific details. In other instances, detailed descriptions of well-known methods and devices are omitted so as to not obscure the present disclosure with unnecessary detail.

The disclosed device is to be used in the aerosol deposition (also known as, aerosol deposition method, universal vacuum deposition, and vacuum kinetic spray deposition) process for film deposition. The device is a capsule that may be filled with a polydisperse size of agglomerates of particles. As used herein, a particle may be an individual solid material in the size range below 5 microns in diameter. An agglomerate may be an aggregation of particles in the size range up to about 500 microns in diameter. The purpose of the device is to provide a means to control the size and uniformity of the particle supply into a chamber for the purpose of creating an aerosol containing a homogenous agglomerate size. The chamber may be vibrated or otherwise mechanically agitated to facilitate agglomerate release from the capsule. A carrier gas may also be used to further agitate the capsule. The uniform agglomerate sized particles may be carried out of the chamber by a carrier gas for the purpose of aerosol sampling or film formation.

Figure 1:
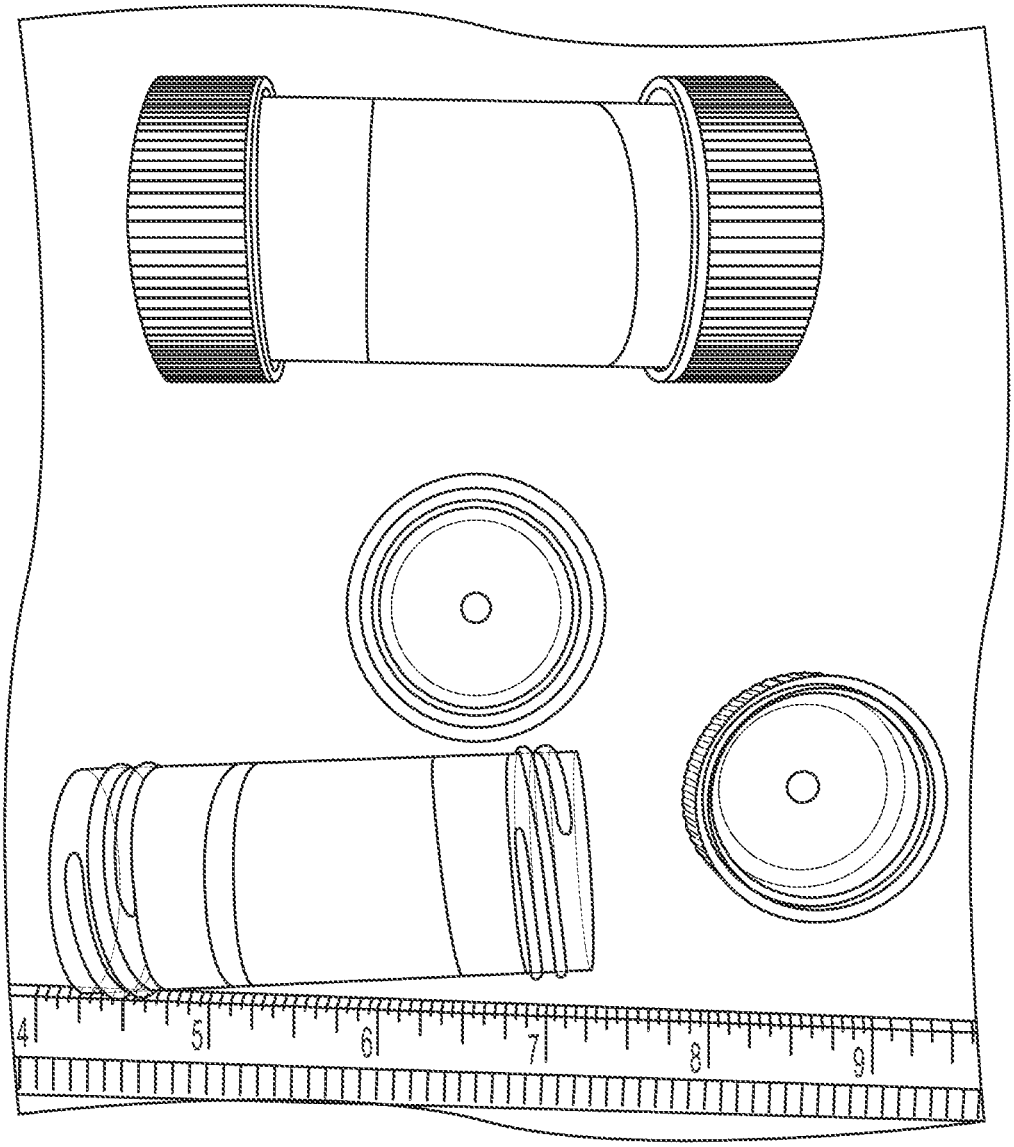
FIG. 1 shows a capsule. The top image is the assembled capsule. The ends are lids to secure the powder inside the mesh body. The bottom image is the same capsule with lids removed for ease of cleaning and removing or adding powder.
Figure 2:
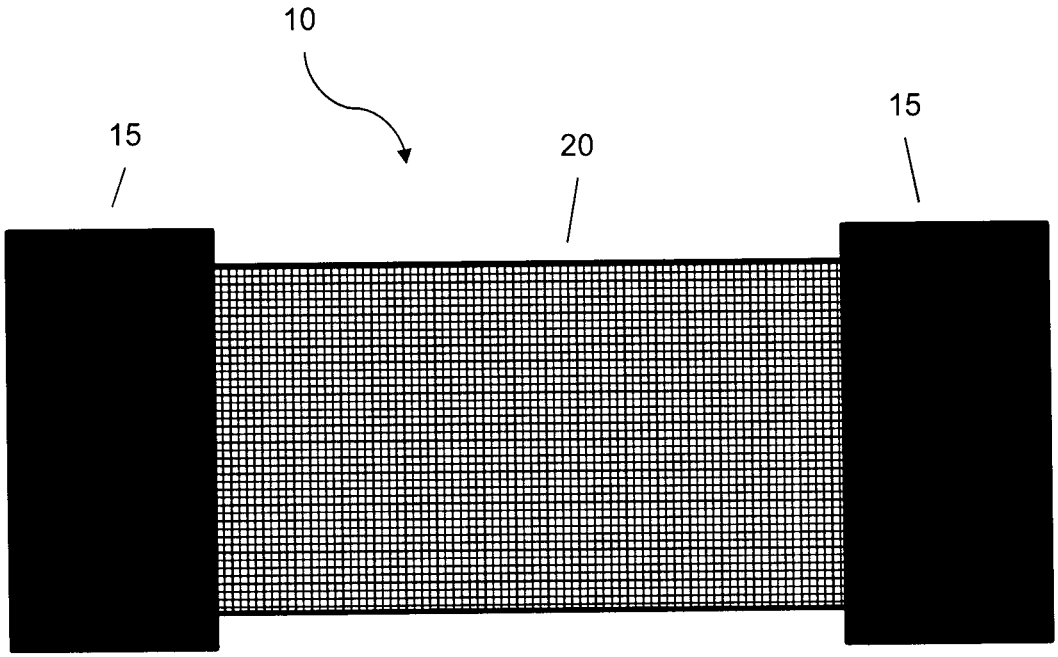
FIG. 2 schematically illustrates an assembled capsule. The ends are lids to secure a powder inside the mesh body.
Figure 3:
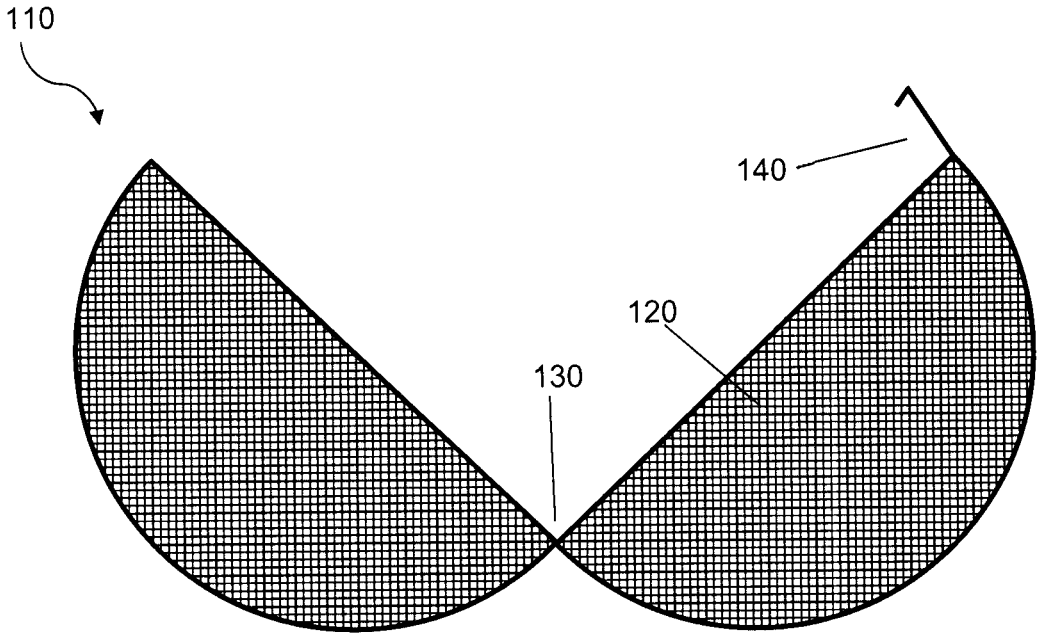
FIGS. 3 and 4 schematically illustrate a spherical capsule design.
Figure 4:
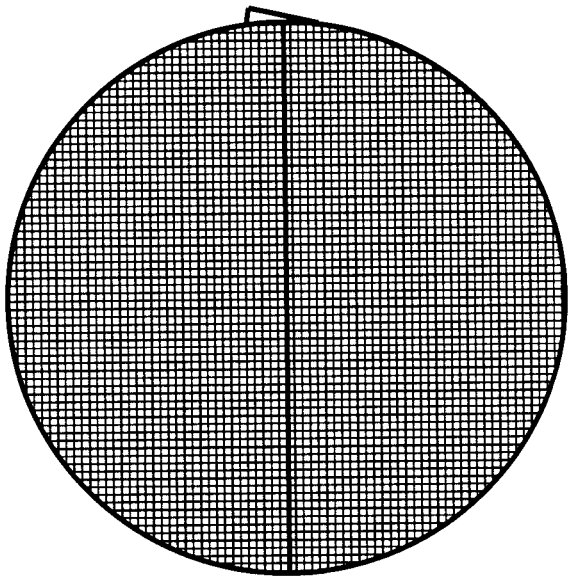
Figure 5:
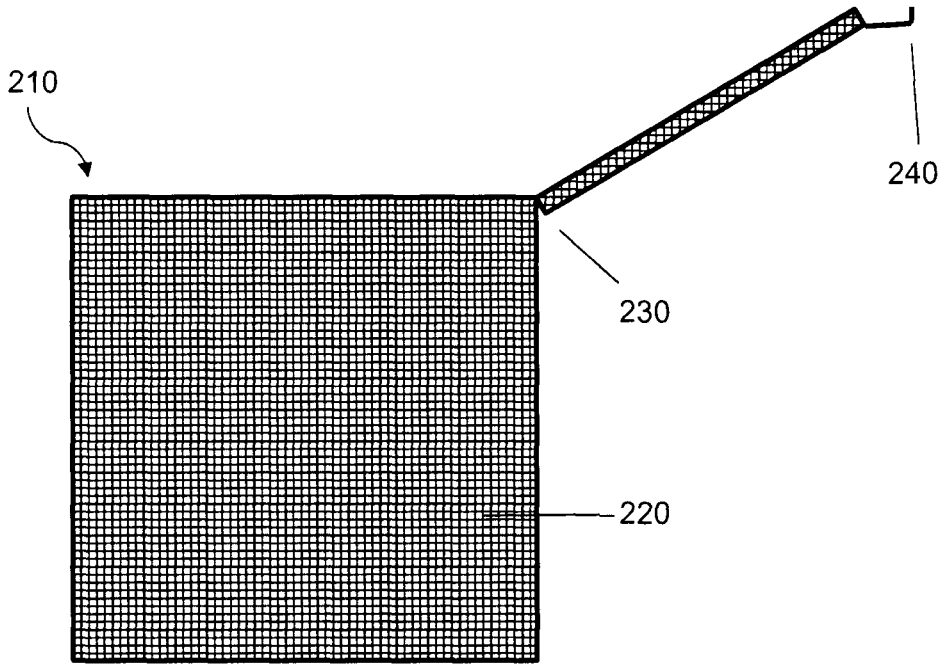
FIGS. 5 and 6 schematically illustrate a cubic or rectangular capsule design.
Figure 6:
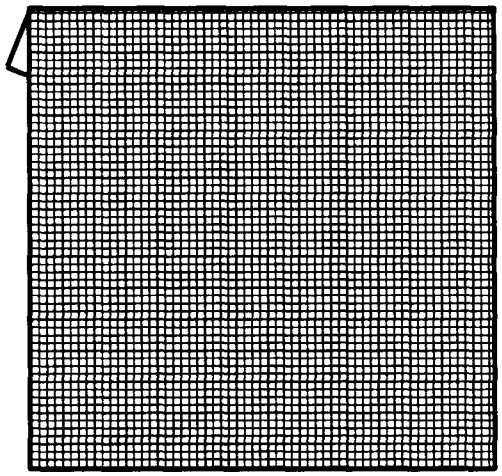

The device is a mesh capsule that is filled with the powder to be used in the aerosol system. The capsule is comprised of a screen mesh that permits size-controlled release of agglomerates into the aerosol chamber. FIG. 1 shows a prototype design that utilizes a mesh screen body and screw cap ends to hold the powder inside. In this implementation, both ends can be removed for thorough cleaning and drying. FIG. 2 schematically illustrates this capsule 10 having caps 15 sealing the ends of the cylindrical mesh 20. The powder may be, but not necessarily sieved, dried, or otherwise treated before loading into the capsule.

Any shape or configuration of the capsule may be used that allows for addition of the powder and closure of the capsule. FIGS. 3-6 show alternative shape designs as a spherical 110 and a cubic 210 shaped capsule, respectively that provides similar operation to the cylindrical shape shown in FIG. 2, but may be more appropriate for aerosol chambers of other sizes or designs. Each design includes a hinge 130, 230 for opening and closing the capsule and a latch 140, 240 for keeping it closed.

The openings in the mesh are no more than 150 microns in diameter, which corresponds to a number 100 mesh. Smaller openings (higher mesh numbers) may also be used. When closed, the capsule should have no other gaps or openings that would allow agglomerates to escape.

Figure 7:
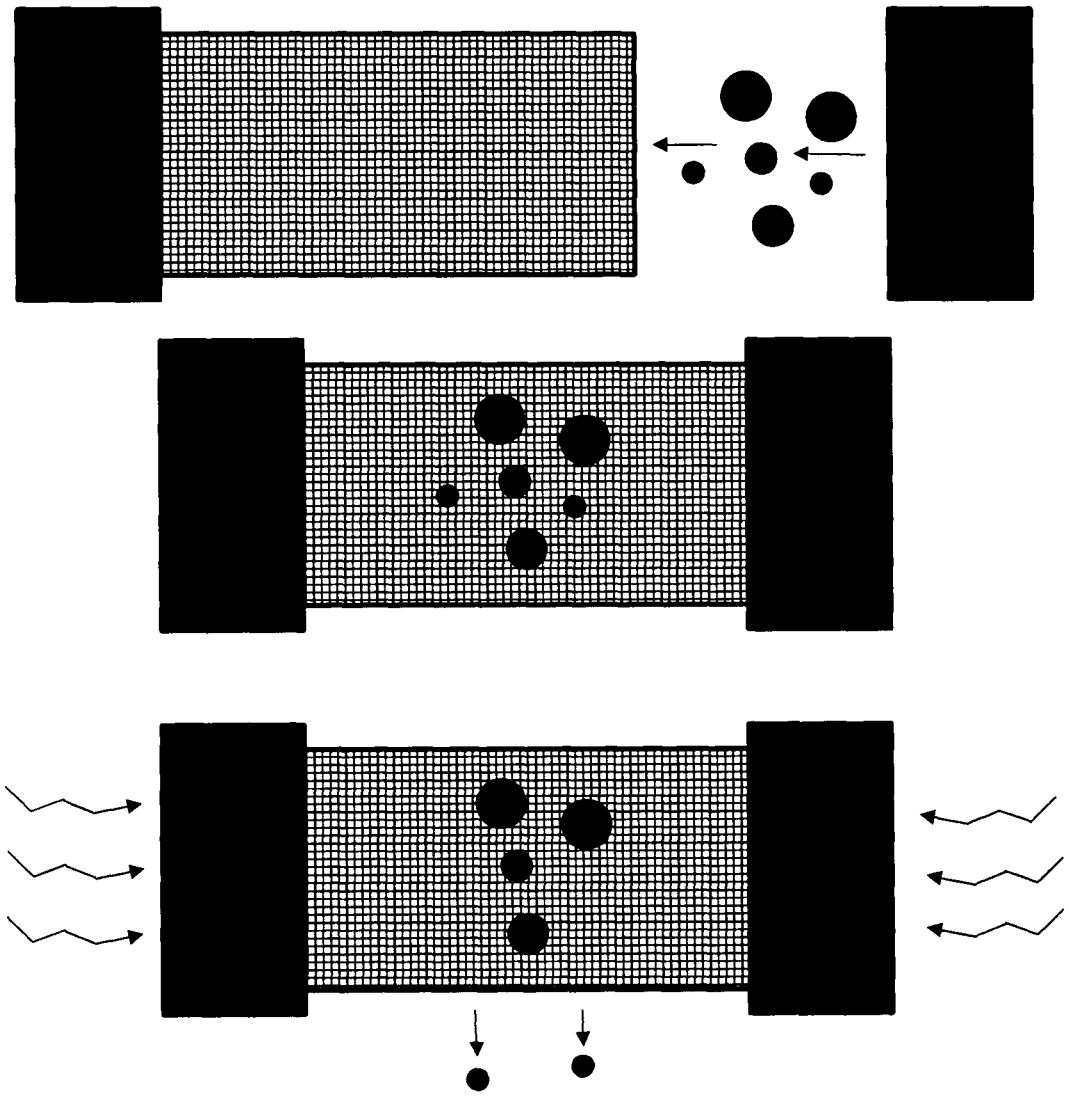
FIG. 7 schematically illustrates the use of the capsule to permit a maximum sized particle into the aerosol.
Figure 8:
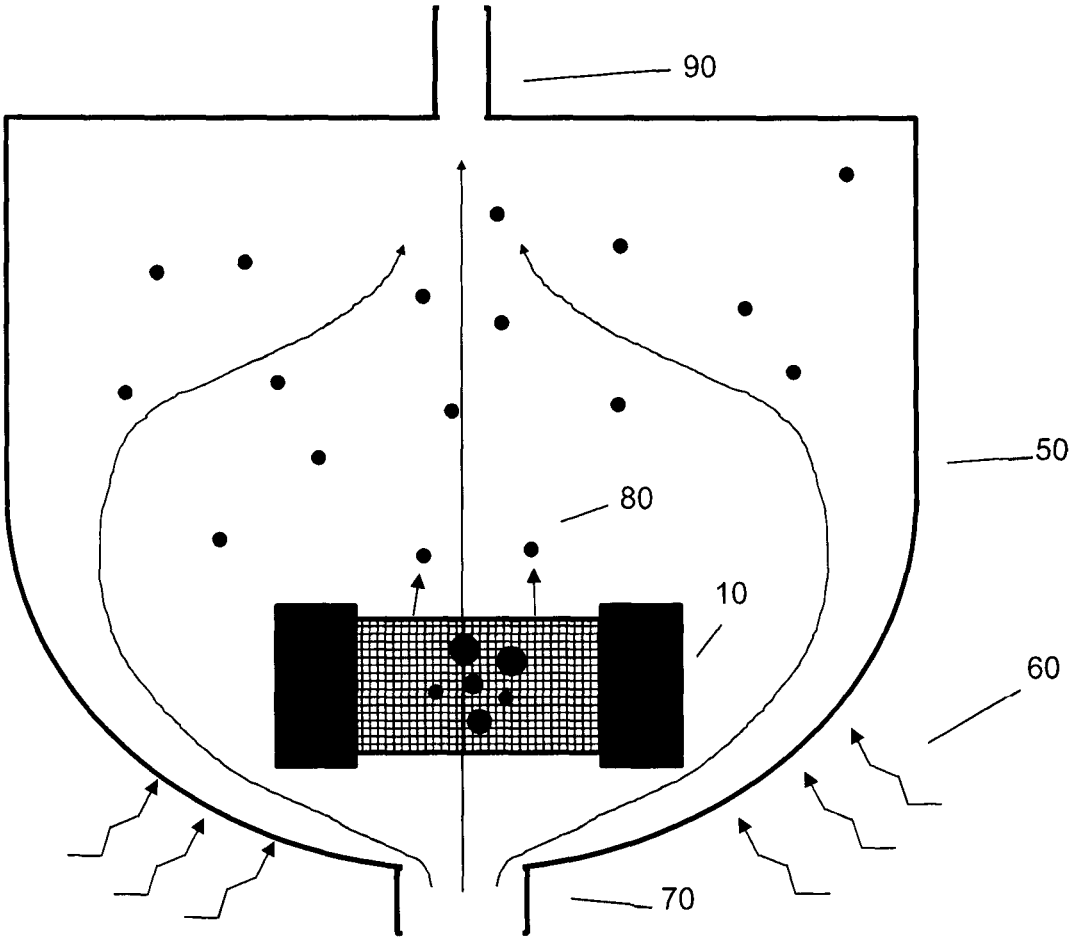
FIG. 8 schematically illustrates the capsule inside an aerosol chamber with carrier gas supplied to assist in carrying the particles to the deposition chamber.

FIG. 7 shows an example of how polydisperse powder may be loaded into the cylindrical capsule shown in FIG. 2. In the first step, the powder is placed in the capsule. In the second step, the capsule is closed using a threaded cap. In the third step, the capsule has been inserted into an aerosol chamber and agitated so that fine agglomerates smaller than the mesh size are released. FIG. 8 shows a capsule 10 inside an aerosol chamber 50 that is being agitated 60 and has a carrier gas supply 70 flowing through the chamber 50. The combined act of agitation and gas flow promotes the powder release 80 and entrainment into the gas flow. The powder is then carried up to the exhaust line 90 where shear forces separate the agglomerates into its constituent particles and into the deposition chamber where the particles impact the substrate to form a film. It can be seen how adding several capsules to the aerosol chamber can increase the amount of material in the aerosol.

Figure 9:
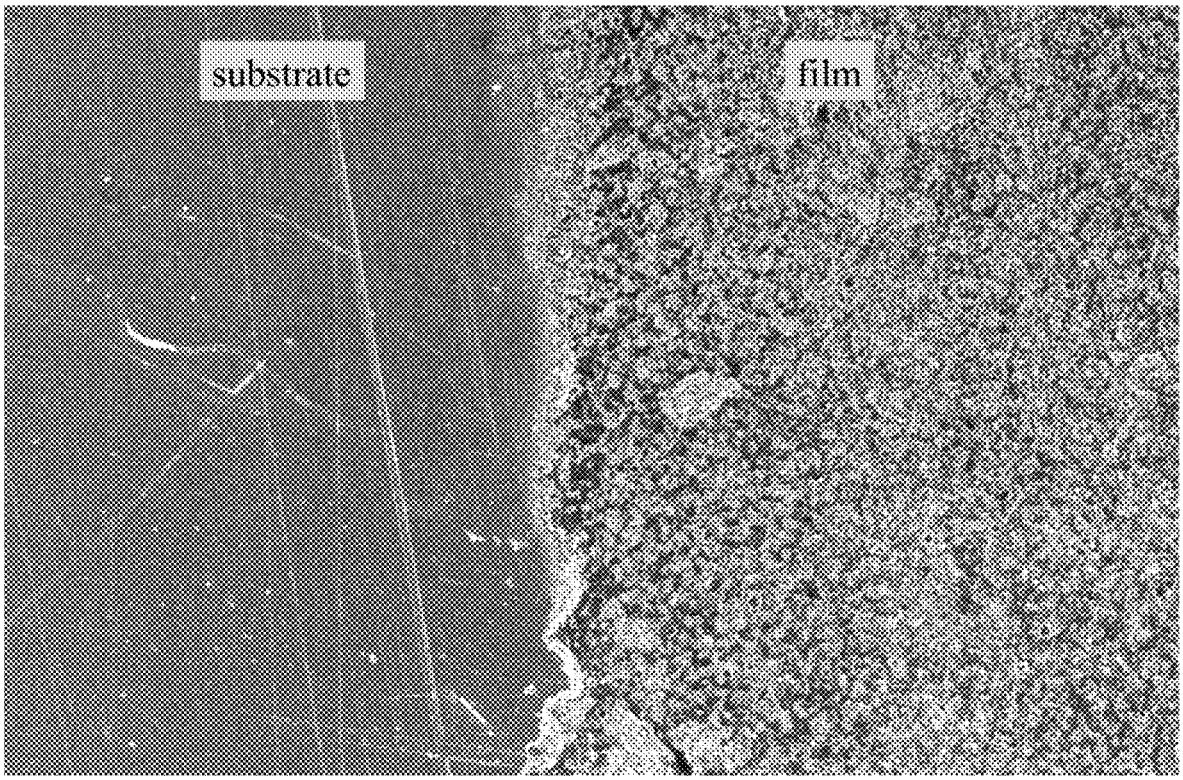
FIG. 9 shows an SEM image showing a film of barium titanate formed by aersol deposition using the capsule for powder control.

FIG. 9 is an SEM image of a film of barium titanate formed onto a platinized silicon substrate using the capsule inside the aerosol chamber of an aerosol deposition system. The image shows the edge of the film deposition where the substrate is exposed to highlight the film.

Figure 10:
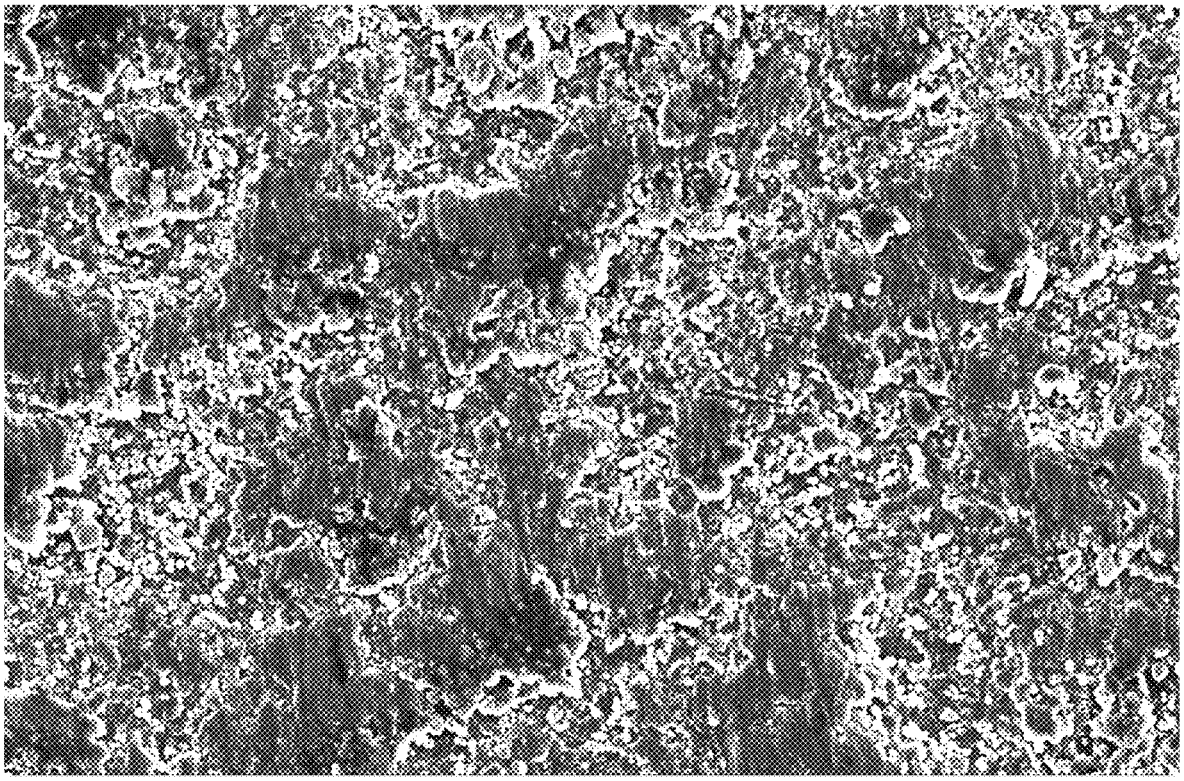
FIG. 10 shows a high magnification image of the barium titanate film in FIG. 9 showing a dense microstructure.

FIG. 10 is a higher magnification SEM image of the same film in FIG. 9 that shows the dense microstructure of the film produced. The film shown in FIGS. 9 and 10 is 2 microns in thickness. In both images it can be seen that the 0.5 micron starting particles have successfully impacted and fractured to form a dense film comprised of grains much smaller than the starting size of the particle.

The capsule overcomes the two problems found in the aerosol deposition process; having agglomerate sizes that are too large and the effect of powder packing in the aerosol chamber as described above. The capsule overcomes these issues by permitting only a narrow range of agglomerate sizes into the aerosol chamber based on the choice of screen mesh. The mesh size can depend on the operator's desired size selection criteria, but typically sizes less than 150 microns in mesh size opening (number 100 mesh) are desirable. The capsule also overcomes the current burden of needing to sieve the powder before insertion into the aerosol chamber, since the capsule itself is an in situ sieve. The effect of packing is also overcome since the bulk of the powder is contained in the capsule and the powder that is released is immediately entrained into the aerosol. Powder contained within the capsule does not become packed because the agitation and gas flow through the mesh continually move the powder within the capsule. Additional milling items such as milling media may be included in the capsule to further promote agglomeration break-up and powder release. The total amount of powder released into the aerosol chamber can be further controlled by choice of mesh screen size and/or the number of capsules used in the aerosol chamber.

Obviously, many modifications and variations are possible in light of the above teachings. It is therefore to be understood that the claimed subject matter may be practiced otherwise than as specifically described. Any reference to claim elements in the singular, e.g., using the articles "a", "an", "the", or "said" is not construed as limiting the element to the singular.

What is claimed is:

1. A method comprising:
providing an apparatus comprising:
a closable container comprising a mesh material having openings and a hinge or a removable seal,
wherein when the container is closed, the openings are the only gaps in the container and
wherein the openings are no more than 150 microns in diameter;
placing a powder into the container;
closing the container;
forcing a gas through the container to cause particles of the powder to emerge from the container through the mesh.

2. The method of claim 1, further comprising:
agitating the container.

3. The method of claim 1, wherein the gas and emerging particles form an aerosol.

4. The method of claim 3, further comprising:
directing the aerosol toward a substrate to create a film on the substrate comprising particles of the powder that have fractured or deformed and bonded to each other.

5. The method of claim 1;
wherein the container is in the form of a cylinder;
wherein the mesh forms the curved surface of the cylinder;
wherein the ends of the cylinder comprise the seals; and
wherein at least one of the seals is removable.

6. The method of claim 1, wherein the container comprises two mesh components joined by the hinge that together form a spherical shape when the container is closed.

7. The method of claim 1, wherein the container comprises two mesh components joined by the hinge that together form a cubical shape when the container is closed.

8. A method comprising:
providing an apparatus comprising:
a closable container comprising a mesh material having openings,
wherein when the container is closed, the openings are the only gaps in the container and
wherein the openings are no more than 150 microns in diameter;
placing a powder into the container;
closing the container;
forcing a gas through the container to cause particles of the powder to emerge from the container through the mesh;
wherein the gas and emerging particles form an aerosol; and
directing the aerosol toward a substrate to create a film on the substrate comprising particles of the powder that have fractured or deformed and bonded to each other.

* * * * *